United States Patent [19]

Buyce

[11] 4,186,769

[45] Feb. 5, 1980

[54] LIQUID MIXING AND DELIVERING APARATUS

[75] Inventor: Dwight D. Buyce, Hendersonville, N.C.

[73] Assignee: Chem-Trend, Inc., Howell, Mich.

[21] Appl. No.: 872,246

[22] Filed: Jan. 25, 1978

[51] Int. Cl.[2] ..... F04B 41/06

[52] U.S. Cl. ..... 137/566; 137/568; 137/98; 417/5

[58] Field of Search ..... 137/567, 568, 558, 88, 137/98, 99; 220/255; 417/3, 4, 5

[56] References Cited

U.S. PATENT DOCUMENTS

| | | | |
|---|---|---|---|
| 2,724,581 | 11/1955 | Pahl et al. | 417/3 |
| 3,394,733 | 7/1968 | Jacuzzi | 137/568 |
| 3,504,686 | 4/1970 | Cooper et al. | 137/568 X |
| 3,595,267 | 7/1971 | Anderson | 137/558 |

*Primary Examiner*—William R. Cline

*Attorney, Agent, or Firm*—Olsen and Stephenson

[57] ABSTRACT

A die lubricant central system which will distribute a diluted material to individual die casting machines, and which includes apparatus for the concentrate holding function, the mixing or proportioning function of the concentrate with a diluent, the diluted material holding function, and the pumping of the diluted material function, all in one integral system.

10 Claims, 2 Drawing Figures

LIQUID MIXING AND DELIVERING APARATUS

BACKGROUND OF THE INVENTION

This invention relates to apparatus for mixing a liquid concentrate and a liquid diluent to form a liquid dilution of desired concentration and for delivering the dilution to work stations.

It is conventional practice to distribute to work stations such as die casting machines, and the like, a liquid die lubricant for application to molding surfaces of the machines. The die lubricant generally is a pre-mixed product that is present initially as a die lubricant concentrate, and is then pre-mixed or proportioned with a diluent, such as water, to provide a diluted material to be sprayed or otherwise applied to the die casting machines. Various forms of apparatus have been employed to carry out this procedure, but none of them have been entirely successful from the standpoint of cost, ease and simplicity of operation, freedom from trouble during operation, accuracy in proportioning, and the like.

SUMMARY OF THE INVENTION

The present invention has overcome the inadequacies of the prior art, and it provides apparatus which incorporates the concentrate holding function, the mixing or proportioning function, the diluted material holding function, and the pumping of the diluted material function in one integral system.

According to a preferred form of the present invention, the apparatus for mixing a liquid concentrate and a liquid diluent to form a liquid dilution of the desired concentration for delivery to work stations comprises a conduit means adapted to be placed in communication at its upstream end with a source of liquid diluent and its downstream end with workstations, the conduit means including a first shut-off valve and a primary pump downstream thereof; a concentrate supply means including a container for the concentrate, and a metering pump in communication with the container and with the conduit means at a location between the first shut-off valve and the primary pump means for metering concentrate into the diluent to form the dilution; accumulator means in communication with the conduit means downstream from the primary pump means for receiving dilution from the primary pump means and returning the same to the conduit means for delivery to the work stations in accordance with preselected pressure conditions; and control means responsive to one of the preselected pressure conditions for actuating the first shut-off valve to an open position and for actuating simultaneously the metering pump means and the primary pump means so that concentrate and diluent can be caused to flow together toward said primary pump means and discharged therefrom toward said work stations as a dilution of desired concentration. The control means is responsive to another of the preselected pressure conditions for deactivating the first shut-off valve so that it returns to a closed position and for deactivating simultaneously the metering pump means and the primary pump means so that flow of the dilution from the primary pump means is interrupted.

In the preferred form of the invention, the accumulator means is a pressure tank having a capacity sufficient to hold a desired quantity of the dilution under pressure, and the control includes a pressure switch responsive to a preselected low pressure, such as 40 psi, and a preselected higher pressure, such as 60 psi of the pressure tank to cause respectively the flow or interruption of flow of the dilution from the primary pump means, the quantity of the dilution in said pressure tank serving to meet demands for dilution from the work stations when the pressure of the dilution is above the preselected low pressure of 40 psi at which time the flow from the primary pump is interrupted.

In one form of the invention, the concentrate supply means includes a storage tank upon which are mounted the pumps, motors, accumulator, and electrical controls, and the storage tank is filled with a concentrated die lubricant. The accumulator is surmounted to hold a small quantity of diluted material under pressure. From this accumulator, the plant requirements are met with local plumbing to fit the installation. When the plant requirements exceed the capacity of the accumulator, the system automatically starts to recharge the accumulator and to supply directly, as needed, the further plant requirements.

Other objects of this invention will appear in the following description and appended claims, reference being had to the accompanying drawings forming a part of this specification wherein like reference characters designate corresponding parts of the several views.

DESCRIPTION OF THE PREFERRED EMBODIMENT

Figure 1:
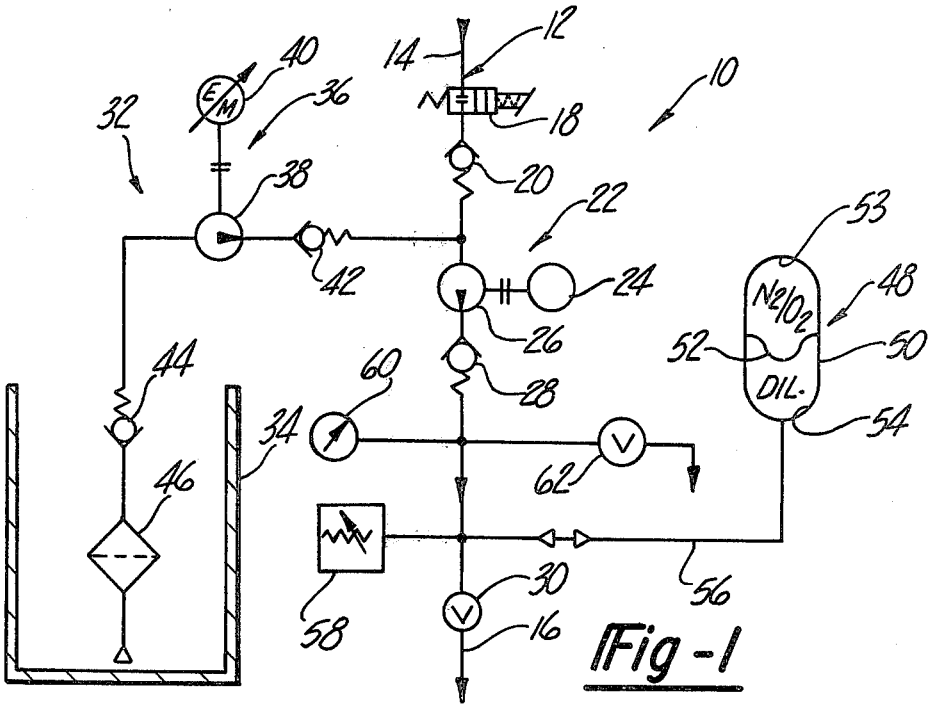
FIG. 1 is a schematic illustration of apparatus embodying the present invention.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the apparatus 10 embodying the preferred form of the invention will be described in greater detail. The apparatus 10 includes conduit means 12 adapted to be placed in communication at its upstream end 14 with a source of liquid diluent, such as water, and at its downstream end 16 with one or more work stations (not shown), such as die casting machines. The conduit means 12 includes the solenoid actuated shut-off valve 18, which normally is in the closed position shown and is adapted to be moved to an open position in response to the solenoid being energized. Immediately downstream of the solenoid actuated shut-off valve 18 is a reverse flow check valve 20 to prevent return flow toward the source of the liquid diluent. Downstream of the check valve 20 is a primary pump means 22 which includes the electric motor 24 and the pump 26 which is coupled thereto to be driven at a constant rpm and displacement. Immediately below the pump 26 in the conduit means 12 is a dilution check valve 28 to prevent return flow. A main shut-off valve 30 is located adjacent to the downstream end of the conduit means 12 for manually shutting off flow of the diluted material to the work stations (not shown).

The concentrate supply means for storing and supplying metered amounts of the liquid concentrate to be mixed and proportioned with the diluent will next be described. The concentrate supply means 32 includes a container 34 for storage of the concentrate and a metering pump means 36 in communication with the container 34 and with the conduit means 12 at a location between the reverse flow check valve 20 and the primary pump means 22 for metering the liquid concentrate into the liquid diluent to form the liquid dilution. The metering pump means 36 includes the variable speed pump 38 which is coupled to a variable speed motor 40, for varying the speed of the pump 38 so that concentration of the dilution that is formed can be selectively determined. The concentrate supply means also includes the concentrate check valve 42 downstream of the metering pump 38 to prevent back flow from the conduit means 12, a foot check valve 44 upstream of the metering pump to prevent return flow of concentrate to the container 34 and a strainer 46 to restrict impurities from inadvertently being introduced into the supply of the liquid concentrate.

The accumulator means 48, which is in communication with the conduit means 12, will next be described. The accumulator means 48 includes the accumulator or pressure tank 50 of a conventional type having a flexible diaphragm 52 to separate the chamber 53 which contains a charge of $N_2/O_2$ and the chamber 54 in which the dilution can be charged by means of a conduit 56 in communication with the conduit means 12 downstream of the check valve 28. Thus, liquid dilution discharged by the primary pump 26 can be charged into the accumulator or pressure tank 50 either when no demand is being made upon the system for liquid dilution or when the demand at the work stations is less than the capacity of the primary pump 26. Because of the location of the check valve 28, liquid dilution discharged from the pressure tank 50 can only be directed to the work stations, if demand is made either for more material than is being discharged by the pump 26 or when the pump 26 is idle.

When the pump 26 is idle, and as system demand requires, the pressure in the accumulator drops to 40 psi at which time a pressure switch 58, responsive to the pressure in accumulator or pressure tank 50, is closed allowing electrical potential to flow in the primary motor 24, variable speed motor 40, and the electric solenoid valve 18. When this happens, three events simultaneously occur.

First, the water valve 18 opens allowing plant water to flow into the primary pump 26. Second, the primary water pump motor 24, driving the direct coupled pump 26 at a constant rpm and displacement, moves a discrete amount of water on into the circuit on a time proportional basis. Third, the variable speed motor 40 is close coupled to the fixed displacement metering pump 38. The metering pump motor 40 is controlled to vary the rpm's and consequently the flow rate of lubricant concentrate in direct proportion to the relative flow rates of both the water and the lubricant concentrate. The motor speed control is set by a variable potentiometer 82.

The lubricant concentrate is introduced to the conduit means 12 downstream of the electrical valve 18 but upstream of the primary pump 26. The mixture is then drawn into the primary pump 26 which aids in dispersing the emulsion mechanically. From the primary pump 26, the dilution is then circuited to the shop system lines (not shown) and the accumulator 50 where supply exceeds system demand and pressure rises.

When the pressure switch 58 senses a rise to 60 psi, the entire electrical circuit, to be described, is broken, stopping both pumps 26 and 38 and closing the water supply solenoid valve 18. All liquid motion upstream from the accumulator 50 then stops but the precharge on the accumulator allows it to feed its small quantity to the work stations as demand requires. When the accumulator pressure drops to 40 psi, the proportioner recycles.

Also located in communication with the conduit means 12 downstream of the primary pump 26 is a pressure gage 60 and a drain valve 62. The latter is located in this position to enable samples of the liquid dilution to be taken, if desired, to determine if the proportioning that has occurred at the pump 26 is proper.

Figure 2:
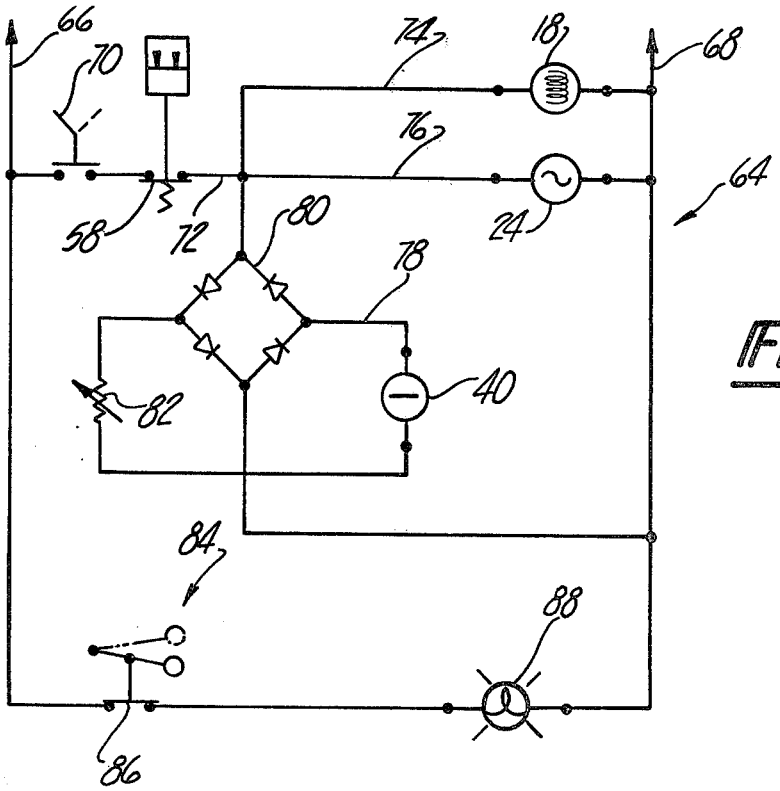
FIG. 2 is a schematic illustration of the electrical controls used in conjunction with the embodiment of the invention illustrated in FIG. 1.

Referring now to FIG. 2, a brief description of the control means 64 will be provided. As thereshown, electrical potential is provided across the lines 66 and 68. A manually actuated switch 70 is provided which when open will prevent flow of current in line 72 and when closed will allow current to flow. Also in the line 72 is the pressure switch 58 which is normally closed and which is adapted to be opened when the pressure in the accumulator or pressure tank 50 reaches 60 psi. Opening of the pressure switch 58 will interrupt electrical potential to lines 74, 76 and 78 thereby deenergizing the solenoid shut-off valve 18, the primary motor 24, and the metering pump motor 40. The latter is a direct current motor and a conventional silicon controlled rectifier 80 is provided so that direct current can be supplied from the alternating current in line 72. The speed of the motor 40 can be selectively set by the variable potentiometer 82. It will also be apparent that when the pressure in the accumulator or pressure tank 50 drops below the lower limit of 40 psi, the pressure switch 58 will automatically close simultaneously allowing the cycle of operation to be repeated.

As optional equipment, additional control means 84 may be in the circuit, including the float switch 86 which will be located in the container 34 and will serve as a low level electrical switch adapted to be actuated when the level of the liquid concentrate drops below a preselected magnitude. In series with the switch 86, when the latter is closed, is an alarm device 88 which may be a lamp, a suitable audible signal, or the like.

It is claimed:

1. Apparatus for mixing a liquid concentrate and a liquid diluent to form a liquid dilution of desired concentration and for delivering the dilution to work stations comprising a conduit means adapted to be in communication at its upstream end with a source of liquid diluent and at its downstream end with work stations, said conduit means including a first shut-off valve and a primary pump means downstream thereof;

a concentrate supply means including a container for said concentrate, and a metering pump means in communication with said container and with said conduit means at a location between said first shut-off valve and said primary pump means for metering concentrate into the diluent to form said dilution;

accumulator means in communication with said conduit means downstream from said primary pump means for receiving dilution from said primary pump means and returning the same to said conduit means for delivery to said work stations in accordance with preselected pressure conditions; and control means responsive to one of said preselected pressure conditions for actuating said first shut-off valve to an open position and for actuating simultaneously said metering pump means and said primary pump means so that concentrate and diluent can be caused to flow together toward said primary pump means and discharged therefrom toward said work stations as a dilution of desired concentration.

2. Apparatus that is defined in claim 1, wherein said control means is responsive to another of said preselected pressure conditions for deactivating said first shut-off valve so that it returns to a closed position and for deactivating simultaneously said metering pump means and said primary pump means so that flow of the dilution from said primary pump means is interrupted.

3. Apparatus that is defined in claim 2, wherein said accumulator means is a pressure tank having a capacity sufficient to hold a quantity of the dilution under pressure, and said control means includes a pressure switch responsive to a preselected low pressure and a preselected high pressure of the pressure tank to cause respectively the flow or interruption of flow of the dilution from said primary pump means, the dilution in said pressure tank serving to meet demands for dilution from said work stations when the pressure of the dilution is above the preselected low pressure and the flow from said primary pump is interrupted.

4. Apparatus that is defined in claim 1, wherein said metering pump means includes variable speed pump and adjustment means for varying the speed of the pump so that the concentration of said dilution can be selectively varied.

5. Apparatus that is defined in claim 1, wherein said conduit means also includes a diluent supply check valve located upstream of said concentrate supply means, and a dilution check valve downstream of said primary pump means and upstream of said accumulator means.

6. Apparatus that is defined in claim 5, wherein said conduit means also includes a main shut-off valve downstream of the location of communication of the conduit means with said accumulator means.

7. Apparatus that is defined in claim 6, wherein said conduit means also includes a drain valve downstream of said primary pump means and upstream of the location of communication of the conduit means with said accumulator means.

8. Apparatus that is defined in claim 1, wherein said concentrate supply means also includes a concentrate check valve downstream of said metering pump to prevent return flow from said conduit means, and a foot check valve upstream of said metering pump to prevent return of flow of concentrate to said container.

9. Apparatus that is defined in claim 1, wherein additional control means are mounted in association with said container for indicating when the level of the liquid concentrate drops below a preselected magnitude.

10. The apparatus that is defined in claim 9, wherein said additional control means includes a low level electrical switch adapted to be actuated when the level of the liquid concentrate drops below said preselected magnitude and an alarm device operable to be activated in response to actuation of said low level electrical switch.

* * * * *